US005449177A

United States Patent [19]

Naylor

[11] Patent Number: 5,449,177

[45] Date of Patent: Sep. 12, 1995

[54] BIBLE GAME AND METHOD OF PLAYING

[76] Inventor: Eddie L. Naylor, 6806 Woodcock La., Spotsylvania, Va. 22553

[21] Appl. No.: 299,404

[22] Filed: Sep. 1, 1994

[51] Int. Cl.[6] ..... A63F 3/00

[52] U.S. Cl. ..... 273/236; 434/245

[58] Field of Search ..... 273/242,243,249,236; 434/245

[56] References Cited

U.S. PATENT DOCUMENTS

| | | | |
|---|---|---|---|
| 4,121,823 | 10/1978 | McBride | 273/249 |
| 4,201,388 | 4/1980 | Cantelon | 273/251 |
| 4,934,709 | 6/1990 | Peterson | 273/249 |
| 4,998,736 | 3/1991 | Elrod | 273/249 |
| 5,042,816 | 8/1991 | Davis et al. | 273/243 |
| 5,067,721 | 11/1991 | Hart | 273/243 |
| 5,152,535 | 10/1992 | Roberts | 273/249 |
| 5,224,862 | 7/1993 | Sullivan | 434/129 |
| 5,295,834 | 3/1994 | Saunders | 273/249 |

*Primary Examiner*—Benjamin H. Layno

*Attorney, Agent, or Firm*—Wigman, Cohen, Leitner & Myers

[57] ABSTRACT

An educational and recreational bible game and method of playing thereof for learning the various biblical scriptures introduces the subject matter of the Bible in a game format in the context of the three biblical personalities as presented in the Christian Bible. The Bible game includes three embodiments of a game board imprinted with a plurality of scripture boxes which are segregated into eight categories representing eight groupings of emotional and physical human attributes. The categorized attributes represented in the three different embodiments include the Spiritual Man, the Carnal Man and the Natural Man. The game is played by selecting a scripture card, placing it on the corresponding scripture box, reading the cited scripture in the Bible and describing it in reference to the biblical personality type of the selected embodiment.

14 Claims, 2 Drawing Sheets

| PERSONALITY TYPE (1104) | SPIRITUAL MAN | CARNAL MAN | NATURAL MAN |
|---|---|---|---|
| PREFIX | A | B | C |
| BOARD/CARD COLOR | PURPLE | GOLD | GREEN |

BIBLE GAME AND METHOD OF PLAYING

FIELD OF THE INVENTION

The present invention relates to an educational board game and a method of playing thereof, and more particularly to an educational board game for teaching biblical knowledge in the context of three biblical characteristics of humankind presented in the books of the Bible.

BACKGROUND OF THE INVENTION

The Christian Bible, which is a compilation of the various books of the Old Testament and the New Testament, forms the basis for religious studies and for the practice of a wide variety of religious observances and beliefs in many cultures in the United States of America and around the world. Accordingly, the teaching of the scriptures of the Bible is considered by those cultures to be of great importance in the education of children and adults alike and for carrying forward those religious beliefs and ideals to future generations. Each of the various books of the Bible, such as Genesis, Exodus, Psalms, Proverbs, Matthew, Mark, Luke, John, Acts, and Revelations, offers a multitude of teachings and parables presented in a significant body of textual material requiring dedicated attention and a significant investment of time to assimilate into a comprehensive understanding.

Various educational devices have been advanced in an effort to ease this learning process and enhance the interest, education and understanding of the teachings of the scriptures of the Bible. For example, U.S. Pat. No. 5,152,535 discloses a Bible quiz game having a game board which directs each of a plurality of players to advance along a sequence of steps defining seven steps to Glory either by providing correct answers to specific biblical questions or by chance. U.S. Pat. Nos. 4,121,823; 4,201,388; and 5,224,862 provide additional religious educational board games in which the players follow a path around the game board. However, none of the aforementioned prior art games introduces the subject matter of the Bible in a succinct format to enhance biblical education in the context of the three biblical characteristics of humankind presented in the various books of the Bible.

SUMMARY OF THE INVENTION

In view of the foregoing, it is apparent that there exists a need for a teaching aid for teaching the subject matter of the Bible in a manner which augments and complements or even substitutes for a formal course of religious instruction in the scriptures of the Bible.

It is therefore an object of the present invention to provide an educational board game, and a method of playing thereof, for teaching biblical knowledge.

It is another object of the present invention to provide an educational and recreational board game for teaching biblical knowledge in the context of the three biblical characteristics of humankind presented in the books of the Bible, as interpreted by the Christian Church.

It is another object of the present invention to provide an educational board game to enable a player to determine his or her level of spiritual and religious enlightenment and development and to identify his or her biblical personality type in terms of Christian models of the Spiritual Man, the Carnal Man, and the Natural Man.

It is another object of the present invention to provide an educational tool for use by a group of biblical scholars or teams of scholars for learning the various biblical scriptures.

It is another object of the present invention to provide an educational tool for use by an individual biblical student for learning the various biblical scriptures in a course of self-study.

The present invention provides an educational and recreational bible game to be played by one or more players for learning the various biblical scriptures. The game introduces the subject matter of the Bible in a game format in the context of the three biblical personality types. A game board is imprinted with sixty three scripture boxes, each scripture box being further identified by one of the three biblical personality types and containing a label stating one of sixty three emotional and physical human attributes. The scripture boxes are further arranged into eight categories including The Realms of Influence, The Heart of Man, The Spirit, The Soul, The Manner of Expression, The Instruments of Expression, The Desired Areas of Expression, and Environment. Each of the scripture boxes further represents a variety of human reactions to/from the environment, such that all of the labels noted in the scripture boxes are thematic of the scriptures corresponding to the sixty three emotional and physical human attributes. The categorized attributes represent in the three different embodiments the Spiritual Man, the Carnal Man, and the Natural Man, and the game is played by selecting a scripture card, placing it on the corresponding scripture box on the game board, reading the cited scripture in the Bible and describing it to the other players who judge whether or not the scripture was properly described in reference to the personality type of the selected embodiment.

With the foregoing and other objects, advantages and features of the present invention that will become hereinafter apparent, the nature of the Bible game of the present invention may be more clearly understood by reference to the following detailed description of the invention, the appended claims, and to the several views illustrated in the attached drawings.

DETAILED DESCRIPTION OF THE INVENTION

Figures 1, 2:
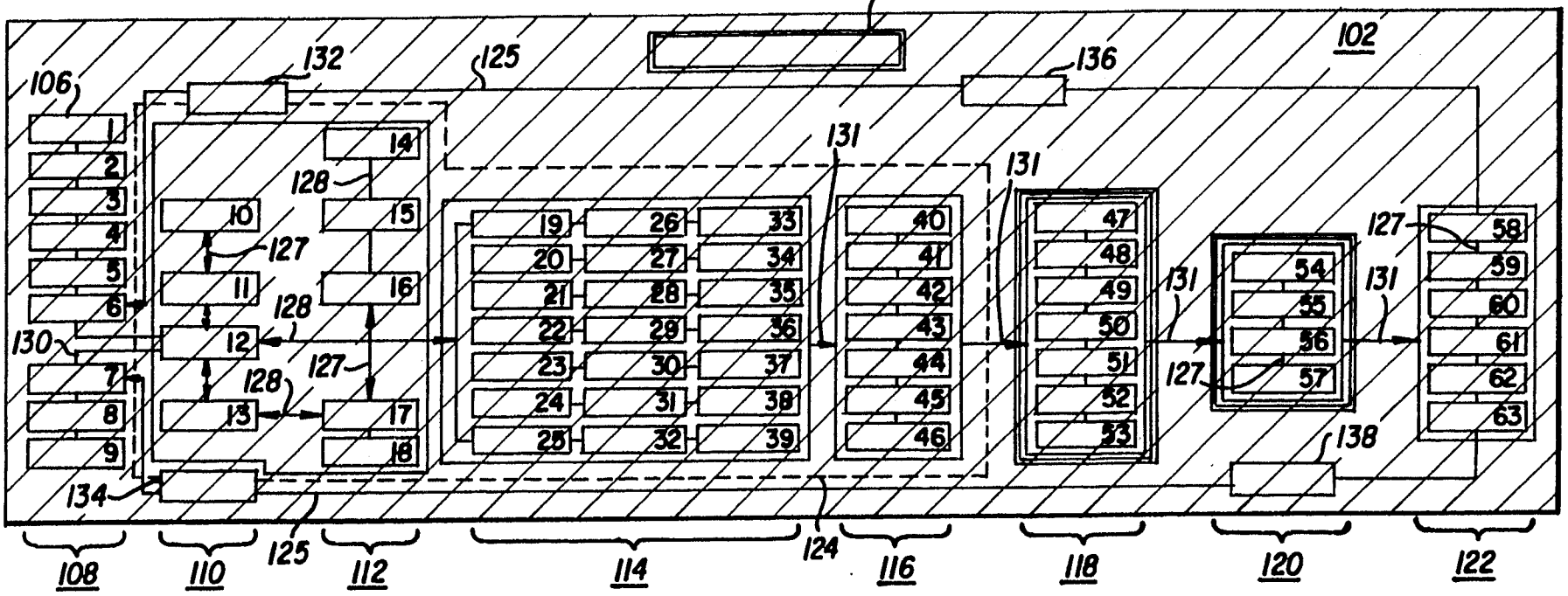
FIG. 1 is a top plan view of the Bible game of the present invention, showing a game playing board depicting sixty three scripture boxes identified by letter prefix and number indicating representative scriptures for each of three different embodiments of the playing board each embodiment representing one of three biblical personality types, the scriptures being arranged into eight categories representing sixty three emotional and physical human attributes, each of the categories and the scriptures being linked in a path of travel to be followed by each player during a course of play or during a course of self-study.
FIG. 2 is a chart listing the three different embodiments of the playing board representing each of three biblical personality types identified by letter prefix and corresponding playing board and scripture card color.

Referring now in detail to the drawings wherein like parts are designated by like reference numerals throughout, there is illustrated in FIG. 1 a game playing board 100 having a rectangular planar playing surface 102. According to the invention and with further reference to FIG. 2, the game playing board 100 is provided in three different embodiments corresponding to the three biblical personality types identified in box 104 as the Spiritual Man, the Carnal Man, and the Natural Man, the corresponding playing board 100 being further identified by prefix A, B and C and by board color purple, gold and green, respectively. It will be understood that additional players or teams of players may be accommodated by additional playing boards identified by other dissimilar colors. As will be appreciated by the biblical student, the Christian Church interprets humankind in the Bible as residing at one of three levels of spiritual enlightenment or "personality." This personality is embodied in the concept of the Spiritual Man, the Carnal Man, and the Natural Man, and the instant invention enables each player to identify his or her personality type in terms of development of his or her spirit, soul and body when compared with Christian religious ideals. More particularly, the Spiritual Man is a believer in a spiritual deity, and successfully attempts to live in full accordance with the spirit and the law provided in the Bible. The Carnal Man believes in the existence of a spiritual deity with full knowledge of the Holy Trinity, but Carnal Man's efforts to lead a wholly spiritual existence is often, even regularly, compromised by the lures of the material world. The Natural Man does not believe in the existence of a deity of any type, and relies upon his own knowledge, experiences and perceptions, understanding of the physical sciences and other extrinsic information to answer all his questions about his existence.

The playing surface 102 is imprinted with sixty three so-numbered scripture boxes 106, each scripture box 106 being further identified by the prefix A, B, or C hyphenated to the scripture box number and containing a label stating one of sixty three emotional and physical human attributes, as listed below in Table 1:

TABLE I

| BLOCK NO. | SPIRITUAL MAN A | CARNAL MAN B | NATURAL MAN C |
|---|---|---|---|
| 1 | HEAVEN | HEAVEN | HELL |
| 2 | GOD THE FATHER | GOD THE FATHER | EVIL ANGELS |
| 3 | GOD THE SON | GOD THE SON | SATAN |
| 4 | GOD THE HOLY GHOST | GOD THE HOLY GHOST | NOT SAVED |
| 5 | HOLY ANGELS | HOLY ANGELS | NATURAL MAN |
| 6 | SPIRITUAL MAN | CARNAL MAN | NATURAL MAN |
| 7 | SPIRITUAL MAN | CARNAL MAN | SATAN |
| 8 | BORN AGAIN | BORN AGAIN | EVIL ANGELS |
| 9 | SAVED | SAVED | HELL |
| 10 | LOVE (FAIL-SAFE) POWER | NOT MATURE STILL WORLDLY | GREEDY SELFISH |
| 11 | FAITH (POWER) | FAITH--MOSTLY RULED BY THE FLESH | FAITH IS UNBELIEF |
| 12 | AWARENESS (CONSCIOUSNESS) | AWARENESS (CONSCIOUSNESS) | AWARENESS (CONSCIOUSNESS) |
| 13 | THE HOLY GHOST | THE HOLY GHOST | SATAN DEVILS |
| 14 | THE SEAT OF INTELLIGENCE | THE SEAT OF INTELLIGENCE | THE SEAT OF INTELLIGENCE |
| 15 | THE SEAT OF WILL | THE SEAT OF WILL | THE SEAT OF WILL |
| 16 | THE SEAT OF GUIDANCE | THE SEAT OF GUIDANCE | THE SEAT OF GUIDANCE |
| 17 | THE SEAT OF CONSCIENCE | THE SEAT OF CONSCIENCE | THE SEAT OF CONSCIENCE |
| 18 | THE SEAT OF CHOICE AND DECISION | THE SEAT OF CHOICE AND DECISION | THE SEAT OF CHOICE AND DECISION |
| 19 | THE SEAT OF PHYSICAL LIFE | THE SEAT OF PHYSICAL LIFE | THE SEAT OF PHYSICAL LIFE |
| 20 | THE SEAT OF SPIRITUAL LIFE | THE SEAT OF SPIRITUAL LIFE | THE SEAT OF SPIRITUAL DEATH |
| 21 | THE SEAT OF KNOWLEDGE | THE SEAT OF KNOWLEDGE | THE SEAT OF KNOWLEDGE |
| 22 | THE SEAT OF HOPE | THE SEAT OF HOPE | THE SEAT OF HOPE |
| 23 | THE SEAT OF DESIRES | THE SEAT OF DESIRES | THE SEAT OF DESIRES |
| 24 | THE SEAT OF AFFECTIONS | THE SEAT OF AFFECTIONS | THE SEAT OF AFFECTIONS |
| 25 | THE SEAT OF PERCEPTION | THE SEAT OF PERCEPTION | THE SEAT OF PERCEPTION |
| 26 | THE SEAT OF PURPOSE | THE SEAT OF PURPOSE | THE SEAT OF PURPOSE |

TABLE I-continued

| BLOCK NO. | SPIRITUAL MAN A | CARNAL MAN B | NATURAL MAN C |
|---|---|---|---|
| 27 | THE SEAT OF THOUGHTS | THE SEAT OF THOUGHTS | THE SEAT OF THOUGHTS |
| 28 | THE SEAT OF UNDERSTANDING | THE SEAT OF UNDERSTANDING | THE SEAT OF UNDERSTANDING |
| 29 | THE SEAT OF REASONING POWER | THE SEAT OF REASONING POWER | THE SEAT OF REASONING POWER |
| 30 | THE SEAT OF IMAGINATION | THE SEAT OF IMAGINATION | THE SEAT OF IMAGINATION |
| 31 | THE SEAT OF WISDOM | THE SEAT OF WISDOM | THE SEAT OF WISDOM |
| 32 | THE SEAT OF ATTITUDES | THE SEAT OF ATTITUDES | THE SEAT OF ATTITUDES |
| 33 | THE SEAT OF PERSONALITY | THE SEAT OF PERSONALITY | THE SEAT OF PERSONALITY |
| 34 | THE SEAT OF EMOTION | THE SEAT OF EMOTION | THE SEAT OF EMOTION |
| 35 | THE SEAT OF MEMORY | THE SEAT OF MEMORY | THE SEAT OF MEMORY |
| 36 | THE SEAT OF HABITS | THE SEAT OF HABITS | THE SEAT OF HABITS |
| 37 | THE SEAT OF PLEASURES | THE SEAT OF PLEASURES | THE SEAT OF PLEASURES |
| 38 | CONTROL VITAL LIFE FUNCTION | CONTROL VITAL LIFE FUNCTION | CONTROL VITAL LIFE FUNCTIONS |
| 39 | THE SEAT OF THE NERVOUS SYSTEM | THE SEAT OF THE NERVOUS SYSTEM | THE SEAT OF THE NERVOUS SYSTEM |
| 40 | THE SEAT OF CHARACTER | THE SEAT OF CHARACTER | THE SEAT OF CHARACTER |
| 41 | THE SEAT OF TEMPERAMENT | THE SEAT OF TEMPERAMENT | THE SEAT OF TEMPERAMENT |
| 42 | THE SEAT OF TRAITS | THE SEAT OF TRAITS | THE SEAT OF TRAITS |
| 43 | THE SEAT OF QUALITIES | THE SEAT OF QUALITIES | THE SEAT OF QUALITIES |
| 44 | THE SEAT OF ATTRIBUTES | THE SEAT OF ATTRIBUTES | THE SEAT OF ATTRIBUTES |
| 45 | THE SEAT OF PROPERTIES | THE SEAT OF PROPERTIES | THE SEAT OF PROPERTIES |
| 46 | THE SEAT OF BEHAVIOR | THE SEAT OF BEHAVIOR | THE SEAT OF BEHAVIOR |
| 47 | THE SIGHT | THE SIGHT | THE SIGHT |
| 48 | THE SOUND | THE SOUND | THE SOUND |
| 49 | THE TOUCH | THE TOUCH | THE TOUCH |
| 50 | THE SMELL | THE SMELL | THE SMELL |
| 51 | THE TASTE | THE TASTE | THE TASTE |
| 52 | THE MOUTH | THE MOUTH | THE MOUTH |
| 53 | THE FEET | THE FEET | THE FEET |
| 54 | CREATIVENESS (WORK) | CREATIVENESS (WORK) | CREATIVENESS (WORK) |
| 55 | WORSHIP | WORSHIP | RELIGIOUS |
| 56 | RECREATION (PLAY) | RECREATION (PLAY) | RECREATION (PLAY) |
| 57 | LOVE | (LOVE) LUST | LOVE (LUST) |
| 58 | SPIRITUAL REALM | SPIRITUAL REALM | SPIRITUAL REALM |
| 59 | PHYSICAL REALM | PHYSICAL REALM | PHYSICAL REALM |
| 60 | MENTAL REALM | MENTAL REALM | MENTAL REALM |
| 61 | ECONOMIC REALM | ECONOMIC REALM | ECONOMIC REALM |
| 62 | SOCIAL REALM | SOCIAL REALM | SOCIAL REALM |
| 63 | ENVIRONMENTAL REALM | ENVIROMENTAL REALM | ENVIRONMENTAL REALM |

The scripture boxes 106 are further arranged into eight categories 108, 110, 112, 114, 116, 118, 120 and 122, as follows:

Scripture boxes 1–9: "The Realms of Influence" (108),

Scripture boxes 10–13: "The Heart of Man" (110),

Scripture boxes 14–18: "The Spirit" (112),

Scripture boxes 19–39: "The Soul" (114),

Scripture boxes 40–46: "The Manner of Expression" (116),

Scripture boxes 47–53: "The Instruments of Expression " (118),

Scripture boxes 54–57: "The Desired Areas of Expression" (120), and

Scripture boxes 58–63: "Environment" (122).

Figure 3:
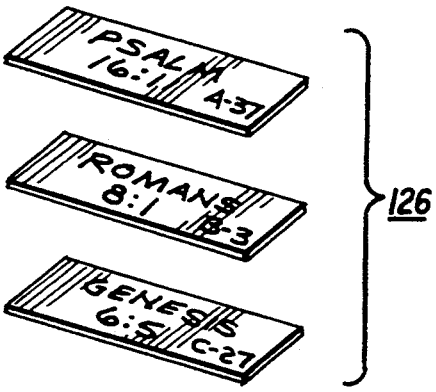
FIG. 3 illustrates three exemplary scripture cards each having at least one scripture reference imprinted thereon, each card identified as shown in FIG. 2 by game board prefix and color.

As will be recognized by a student of biblical studies, each of the scripture boxes 10–46, circumscribed by dashed line 124, further represent a variety of human reactions from the environment, and scripture boxes 47–63 represent a variety of human reactions to the environment, wherein all of the legends noted in all of the scripture boxes 106 are thematic of the scriptures cited in a set of exemplary scripture cards 126 shown in FIG. 3 and provided in TABLE 2, which are to be placed in the corresponding scripture box 1–63 during the play of the game, as will be more fully described below. Alternatively, the information shown in TABLE 2 may be imprinted on the face of each game board 102, on a wall portion of a game container (not shown) or made available in individual instruction sheets (not shown) to be distributed to each game player.

TABLE 2

| BLOCK NUMBER | SPIRITUAL MAN A | CARNAL MAN B | NATURAL MAN C |
|---|---|---|---|
| 1 | II COR. 5:1, 2<br>HEBREWS 13:14 | I KINGS 8:30 | REV. 21:8 |
| 2 | ROMANS 8:31 | ROMANS 8:7 | MATTHEW 25:41 |
| 3 | PHIL. 4:13, 19 | ROMANS 8:1 | JOHN 8:44 |
| 4 | ROMANS 8:11 | ZECH. 4:6 | 1 COR. 2:14 |
| 5 | PSALMS 34:7<br>HEBREWS 1:14 | HEBREWS 1:14 | 1 TIM. 2:5 |
| 6 | ROMANS 7:22 | ROMANS 7:14 | JEREM. 17:9 |
| 7 | II COR. 5:17 | ROMANS 8:6 | II COR. 4:4 |
| 8 | I PETER 1:22, 23 | JOHN 3:3 | REV. 12:7, 8 |
| 9 | HEBREWS 7:25 | ACTS 2:21 | MATTHEW 25:46 |
| 10 | I JOHN 4:18<br>JOHN 15:12, 13 | ROMANS 12:2 | ISAIAH 56:11 |
| 11 | GAL. 5:6<br>EPH. 6:16 | ROMANS 8:8<br>HEBREWS 11:6 | JAMES 2:19<br>MATTHEW 13:58 |
| 12 | MATT.22:36–40 | I THES. 5:6 | ROMANS 1:18–20 |
| 13 | ROMANS 8:14–17 | JOHN 16:13 | MATTHEW 12:29 |
| 14 | COLOSSIANS 3:10<br>II TIM. 3:7 | HOSEA 4:6 | I COR. 8:1 |
| 15 | HEBREWS 13:18<br>EPH. 5:17 | MATTHEW 26:41 | I CHRON. 28:9 |
| 16 | JEREMIAH 33:3<br>JOHN 16:13, 14 | PSALM 32:8 | PROV. 6:14 |
| 17 | ACTS 24:16 | I COR. 8:12 | I TIM. 4:2 |
| 18 | PSALMS 25:12<br>JOEL 3:14 | JOSHUA 24:15<br>JOEL 3:14 | DEU. 30:19<br>I KINGS 20:40 |
| 19 | LUKE 12:15 | PROV. 4:23 | JAMES 2:26 |
| 20 | JOHN 1:4, 5:26<br>JOHN 14:6 | JOHN 6:63 | EPHES. 2:3 |
| 21 | PHILIP. 3:8 | HOSEA 4:6 | ROMANS 1:28 |
| 22 | HEBREWS 6:19, 20 | ROMANS 8:24 | PROV. 26:12 |
| 23 | PSALMS 21:2<br>PSALMS 37:4 | I PETER 2:2 | PSALMS 140:8 |
| 24 | COLOSS. 3:1–3 | COL. 3:2 | ROMANS 1:26 |
| 25 | ACTS 10:34<br>MATTHEW 13:14 | ISAIAH 6:9 | ISAIAH 6:9 |
| 26 | ACTS 11:23<br>ECCLES. 3:1<br>ROM. 8:28 | ACTS 11:23 | ISAIAH 14:27 |
| 27 | PROV. 12:5<br>PROV. 16:3 | PROV. 23:7 | GENESIS 6:5 |
| 28 | PROV. 8:8, 9 | PROV. 3:5–8 | RONUNS 3:10–18 |
| 29 | JOB 13:3<br>ISAIAH 1:18 | JOB 15:2–6 | ISAIAH 1:18 |
| 30 | II COR. 10:5 | II COR. 10:5 | GENESIS 8:21 |
| 31 | JAMES 1:5, 7<br>JAMES 3:17 | JAMES 1:5<br>JAMES 3:17 | JAMES 3:15 |
| 32 | HEBREWS 4:12 | PROV. 16:9, 25 | PROV. 4:19 |
| 33 | COL. 1:10<br>ROM. 8:29 | MATTHEW 7:<br>15:20 | PSALMS 14:1 |
| 34 | I PETER 1:22<br>PROV. 17:27 | PROV. 16:32 | ACTS 7:54, 57 |
| 35 | ACTS 20:35 | I COR. 15:2 | PSALMS 109:14–17 |
| 36 | LUKE 18:1<br>PROV. 18:8 | PROV. 17:4, 20 | II SAM. 22:28 |
| 37 | PSALMS 16:11 | LUKE 8:14 | II TIM. 3:4 |
| 38 | PROV. 17:22<br>PROV. 18:20, 21 | PSALMS 139:<br>13–16 | PROV. 18:21 |
| 39 | PROV. 4:20–23<br>PROV. 16:24 | JAMES 3:6 | PROV. 18:14 |
| 40 | GAL. 5:22, 23 | I PETER 1:16 | TITUS 1:16 |
| 41 | MATTHEW 22:37 | I COR. 7:9 | II PETER 2:12 |
| 42 | EPH. 4:32 | HEBREWS 5:8 | II THES. 2:12 |
| 43 | EPHES. 6:10:19 | JAMES 1:4 | JAMES 4:1–4 |
| 44 | MATTHEWS 5:7<br>PROV. 19:11 | PROV. 12:25 | PROV. 29:27 |
| 45 | I TIMOTHY 4:12 | PROV. 1:32 | PROV. 30:14 |
| 46 | II COR. 5:20<br>COL. 4:6 | HEBREWS 12:<br>1–3 | EXODUS 32:9 |
| 47 | PSALMS 19:8<br>PSALMS 32:8 | MARK 8:18 | I SAM. 18:9 |
| 48 | PSALMS 34:15<br>PROV. 25:12 | MATTHEW 13:15 | II TIM. 4:3, 4 |
| 49 | PSALMS 24:4, 5 | PROV. 10:4 | PSALMS 9:16, 28:5 |
| 50 | PHILIP. 4:18 | AMOS 4:10 | ISAIAH 65:5 |
| 51 | PSALMS 34:8<br>PSALMS 119:103 | PSALMS 119:103 | MICAH 6:12 |

TABLE 2-continued

| BLOCK NUMBER | SPIRITUAL MAN A | CARNAL MAN B | NATURAL MAN C |
|---|---|---|---|
| 52 | MALACHI 2:6<br>HEBREWS 13:15 | COL. 3:8, 9 | PSALMS 17:10 |
| 53 | PSALMS 119:105 | LUKE 1:79 | PROV. 1:16 |
| 54 | EPH. 2:10<br>II TIM. 2:15 | EPH. 2:10 | JOHN 7:7 |
| 55 | GAL. 2:20 | MATTHEW 4:10 | II TIM. 3:5 |
| 56 | I PETER 1:15 | I COR. 10:7 | LUKE 12:15–21 |
| 57 | EPH. 5:2<br>JAMES 4:4 | I JOHN 2:15<br>II THES. 2:10–12 | I JOHN 2:16 |
| 58 | PROV. 20:27 | MATTHEW 22:37 | GAL. 5:19–21 |
| 59 | ROMANS 8:11 | ROMANS 12:1 | EPH. 5:11, 12 |
| 60 | HEBREWS 5:14 | ROMANS 12:2 | PHIL. 3:19 |
| 61 | LUKE 6:38<br>MALACHI. 3:8 | DEU. 8:18 | I TIM. 6:10 |
| 62 | II COR. 1:12<br>PHIL. 3:20 | MATTHEW 22:39<br>PSALMS 11:5 | PSALMS 10:4 |
| 63 | ROMANS 8:22 | ROMANS 8:22 | ROMANS 8:22 |

The scripture boxes 106 are linked in a closed path of travel 125 with the categories 108, 110, 112, 114, 116, 118, 120 and 122, further providing travel links 127 joining two scripture boxes in a common category, travel links 128 between two scripture boxes in different categories or travel links 13 1 between two categories to be followed by each player during a course of play or during a course of self-study, as will also be more fully described below.

Figure 4:
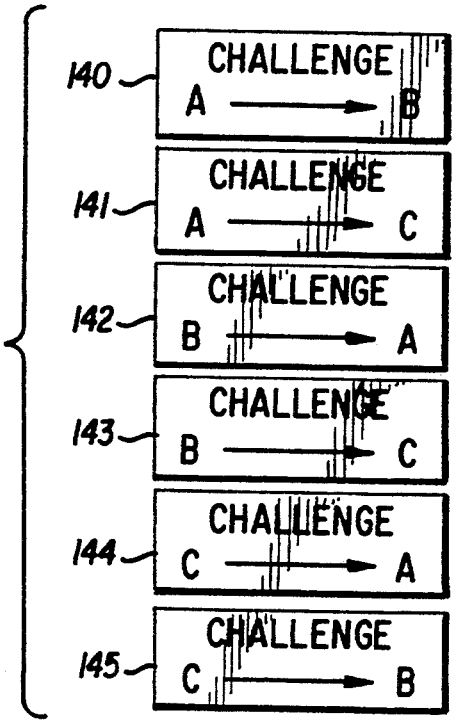
FIG. 4 illustrates a set of six "CHALLENGE" cards showing the various available challenges for a game to be played by three players.

With reference to FIG. 4, a set of six "CHALLENGE" cards 140–145 color-coded for each gameboard 100 (FIG. 2) provides every possible challenge combination by one player against either of two other players during the play of the game.

Figure 5:
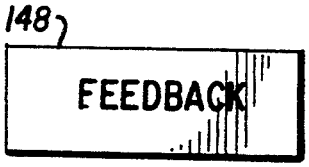
FIG. 5 illustrates an exemplary "FEEDBACK" card for use during the course of play.
Figure 6:
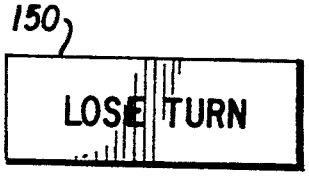
FIG. 6 illustrates an exemplary "LOSE TURN" card for use during the course of play.
Figure 7:
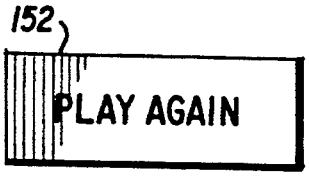
FIG. 7 illustrates an exemplary "PLAY AGAIN" card for use during the course of play.

With reference to FIG. 5, a set of ten "FEEDBACK" cards 148 color-coded for each game board 100 (FIG. 2) indicates that game play reverts to the last active player. FIG. 6 shows a self-explanatory "LOSE TURN" card 150 (a set of three provided for each player) applicable to the active player. FIG. 7 shows a "PLAY AGAIN" card 152 (a set of three provided for each player) allowing the active player to choose one of three options, to be more fully described below.

Chance boxes 132, 134, 136 and 138 are linked to the closed path of travel 125. A chance card selected from the set of "CHALLENGE" cards 140–145, "FEEDBACK" cards 148, "LOSE TURN" cards 150, or "PLAY AGAIN" cards 152 is placed in the corresponding chance box 132, 134, 136 or 138 in response to the direction given on the face of that card, as will be more fully described below.

Figure 8:
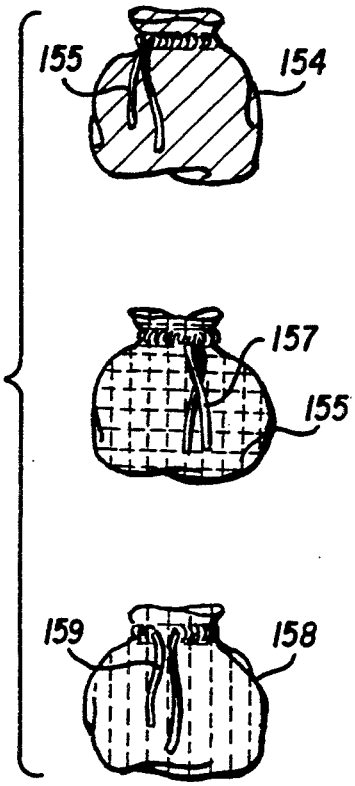
FIG. 8 is a front elevational view of a set of color-coded sacks corresponding to the color coding shown in FIG. 2 for containing the scripture cards corresponding to a particular biblical personality type.
Figure 9:
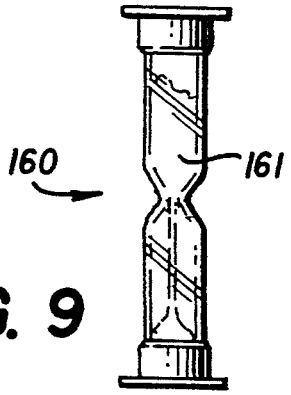
FIG. 9 shows a time-keeper for timing each player's period for response.

Referring now to FIG. 8, three sacks 154, 156, 158 corresponding to playing board colors purple, gold and green, respectively, are provided to each player or team of players for containing the like-colored scripture cards 126 along with the additional cards 148, 150, 152. The sacks 154, 156, 158 are optionally provided with string cinches 155, 157, 159, respectively to securely contain the playing cards during transport of the game. As shown in FIG. 9, a time-keeper 160 such as a three-minute egg timer partially filled with a fluid 161 such as sand or water, or any other timer enabling the measurement of longer or shorter time intervals as mutually agreed enables the players to maintain a consistent count or to limit the time spent by each player during his or her turn.

PLAYING THE GAME

Prior to playing the game, one of the three sacks 154, 156, 158 is chosen from which each player/team selects a scripture card 126. The lowest number selected (1–63) entitles that player (or team of players) to chose one of the three embodiments of the game board 100. The player who selects the next lowest number chooses from the remaining two game boards, and the remaining game board is assigned to the third player.

Next, the players should mutually agree to any time constraints such as the maximum period of time to be allotted to the playing and completion of the game and to each player's turn. Also, the players should mutually agree to a selected version of the Bible, such as the King James Version, to eliminate the potential for textual and interpretational differences between different versions of the Bible which might hinder the playing of the game. A player who is playing the game as a form of self-study may choose any sack and its corresponding game board and commence play.

To begin play for more than one player, the player who initially chose the lowest number selects a card from the sack corresponding in color to the playing board he previously chose. If the selected card is a scripture card 126, it will be imprinted with one or more Bible scripture citations. The first player then places the card 126 on the corresponding scripture box labeled by individual scripture box numbers, and reads the appropriate scripture(s) from the Bible and notes its biblical value in relation to biblical personality type and category. If a LOSE TURN card 150 is drawn, then the first player loses his turn and play continues in a clockwise fashion amongst the other players. If, however, the first player initially draws a PLAY AGAIN card 152, then that player may exercise the option of immediately drawing and playing a second card or deferring his next play for a later time.

The game proceeds in like fashion for each scripture card 126 selected by the competing players. If a FEEDBACK card 148 is drawn after the start of the game, the play of the game reverts to the previous player, who must 1) describe the scripture he previously selected, and 2) apply the teaching of the scripture to the "Personality" of the corresponding category 108–122 and the biblical personality trait of his game board. The other players review and judge the proffered description of the scripture and its application for accuracy and completeness.

If it is concluded by the other players that the scripture was sufficiently described and applied in the manner indicated above, then the scripture card is retained in place on the tested player's game board and the FEEDBACK card 148 is also added to that player's game board. If the tested player is judged to have provided an unsatisfactory description of the target scripture(s), then both cards are returned to that player's sack, and the game is resumed in order by the next player. If the player cannot sufficiently describe the "Personality," then he may pass to the next player in order, but such passage must be completed before any attempt is made to complete that description. Thus, any attempt to describe the "Personality" nullifies the player's option to pass. If that player chooses to pass without attempting a "Personality" description, then both cards remain on his game board. If, however, the next player successfully completes the "Personality" description, then both cards are returned to the first player's sack to be replayed later, time permitting.

If a CHALLENGE card 140–145 is drawn from the current player's bag, then the following rules apply. The challenged player, i.e., the player listed to the right of the arrow of the CHALLENGE card (FIG. 2), must satisfactorily describe at least two related scriptures in addition to those scripture(s) noted on a selected scripture card 126 selected by the challenged player, and those descriptions must be satisfactorily completed within one (1) minute from the time of selection. The challenging player is listed to the left of the arrow of the CHALLENGE card. If the descriptions are completed satisfactorily in the manner previously described, then the challenging player must remove both the original scripture card 126 and the CHALLENGE card and return them to his sack for reuse. For two players, challenge cards 144 and 145 are removed from the sacks of the participating players prior to the beginning of the game. All FEEDBACK and CHALLENGE cards are color-coded for the purpose of assisting in the return of those cards to the corresponding sack at the end of the game.

If a PLAY AGAIN card 152 is drawn, then that player retains the option of immediately playing another turn or retaining that PLAY AGAIN card 152 for play during another round, in order. Alternatively, a PLAY AGAIN card may be applied against a LOSE TURN card, and the player continues play in the regular order.

A player who draws a LOSE TURN card 150 is obligated to sit out his turn or apply it against a PLAY AGAIN card to continue play in the regular order.

For a single player who is playing the game for self-study, the CHALLENGE cards, FEEDBACK cards, LOSE TURN cards and PLAY AGAIN cards are removed from his sack prior to commencement of the game or are merely disregarded during play.

The game ends either at the preappointed time, or alternatively may be played in an incremental manner over a period of time extending hours, days or even weeks. Alternatively, it is contemplated that the game when used as a teaching tool in a formal teaching institution may be played over the course of a school semester or school year in an effort to fully develop the biblical and spiritual interpretation of each selected scripture.

If so achieved within the above-listed time constraints, the game is ended when one player successfully covers all of his scripture, FEEDBACK and CHALLENGE boxes, at which time he calls out "Personality." If the game is ended before any player has successfully completed his game board, then the player with the greater number of scripture cards wins the game. A tie game requires overtime play, which consists of a Challenge, in which each player has one minute to describe the greatest number of scriptures related to the previous scripture box played by each player. The tying player then performs the same exercise and turns are alternated until the tie is broken by the player who recites the larger number of scriptures related to the selected one of the eight categories 108–122. If the previous category has been exhausted, then the next player selects another category of his choice.

In either circumstance, however, the highest-scoring player, after calling out "Personality" to indicate his score, must successfully complete a final, free-form challenge. The second-highest scoring player challenges the highest scorer by writing down the name of a selected biblical, historical or present day Personality associated with his playing board personality and concealing it from the view of the highest-scoring player. The challenged player has one minute to either name or describe the selected Personality that depicts the Personality of that player's game board, after which he forfeits his victory to the challenger, who in turn calls out "Personality." A third player, if present, provides in the interval of one minute a number of challenge clues in the manner previously described. This sequence then continues with the highest-scoring player and the remaining players in order until the "Personality" is successfully identified by the ultimate winner.

Accordingly, it will be appreciated that an enhanced knowledge of the Bible should be gained through use of this game 1 00 when used as a teaching or educational tool, or even as a recreational game.

Although a preferred embodiment of the Bible game of the present invention has been described herein and fully illustrated by the drawing figures, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What I claim is:

1. A board game, comprising:

a game board having thereon a plurality of labeled scripture boxes arranged into a plurality of labeled categories, said scripture boxes being contiguous within each said category said categories being arranged in a closed circuit; and a plurality of scripture cards each identified by a corresponding scripture box label, each scripture card having thereon an indicia representing at least one biblical scripture such that each said scripture card is assignable to a corresponding scripture box during the play of the game;

a chance box located in said closed circuit between a selected pair of categories;

at least one each of a set of chance cards identified by label as CHALLENGE, FEEDBACK, PLAY AGAIN or LOSE TURN; and a plurality of CHALLENGE cards each identifying by label a permutation of challenge among a plurality of players.

2. The board game of claim 1, wherein said plurality of scripture cards is further identified by a common theme label representing a biblical characteristic of humankind.

3. The board game of claim 1, wherein said common theme is selected from a group representing the Spiritual Man, the Carnal Man, and the Natural Man.

4. The board game of claim 1, wherein each said scripture box is labeled with an attribute selected from a set of about 63 emotional and physical human attributes.

5. The board game of claim 1, wherein said categories include The Realms of Influence, The Heart of Man, The Spirit, The Soul, The Manner of Expression, The Instruments of Expression, The Desired Areas of Expression, and Environment.

6. The board game of claim 1, wherein said chance box is identified by label as one of CHALLENGE, FEEDBACK, PLAY AGAIN or LOSE TURN.

7. The board game of claim 1, further comprising a time-keeping means for timing a playing of a scripture card by a player.

8. The board game of claim 1, further comprising a sack for containing one set of scripture cards having a common theme selected from a group representing the Spiritual Man, the Carnal Man, and the Natural Man.

9. A method of playing an educational board game by at least one player, comprising the steps of:

(a) providing to the player a game playing board having a game playing region having a plurality of labeled scripture boxes arranged into a plurality of categories having a common biblical theme, each category labeled with an attribute selected from a predetermined set of human attributes, said scripture boxes being contiguous within each said category, said categories being arranged in a closed circuit;

(b) providing to the player a set of scripture cards identified by a common theme label corresponding to the common theme of said game playing board;

(c) selecting a scripture card by each player;

(d) reading from a bible a biblical scripture referenced by said scripture card;

(e) placing said selected scripture card to a corresponding labeled scripture box; and (f) repeating steps (c)–(e).

10. The method of playing a board game of claim 9, comprising the additional steps of:

(g) providing a set of a plurality of scripture cards and a corresponding game playing board each set having a unique biblical theme to each of a plurality of players;

(h) providing a set of labeled chance cards having indicia for directing a player's movement on said game playing board to each of the plurality of players, and combining said set of chance cards with said plurality of scripture cards into a pool;

(i) selecting at random a card from said pool and reading said labeled information;

(j) if said selected card is a scripture card, then repeating steps ((d)–(e) and advancing the play of the game in a predetermined order to the next player; and (k) following the direction on said selected chance card.

11. The method of playing a board game of claim 10, comprising the additional steps of:

(l) passing the play of the game to the next player if a LOSE TURN chance card is selected;

(m) selecting another card by a current player if a PLAY AGAIN chance card is selected, or applying said PLAY AGAIN chance card against said LOSE TURN chance card to resume play in said predetermined order of play; and (n) repeating step (i) by the next player.

12. The method of playing a board game of claim 10, comprising the additional steps of:

(o) if a FEEDBACK chance card is selected, then

I. said previous player describing the scripture(s) previously read in step (i) and applying the teaching(s) of the scripture(s) to a "Personality" of a corresponding category to which said scripture card was assigned and to the personality trait of the unique biblical theme of the corresponding game board;

II. reviewing and judging by the other players of said description for accuracy and completeness;

III. retaining in place on the game playing board the corresponding scripture card if said description is deemed by the other players to be sufficiently described; and IV. adding the "FEEDBACK" chance card to the corresponding block on the previous player's game board; and (p) repeating step (i) by the next player.

13. The method of playing a board game of claim 10, comprising the additional steps of:

(q) if a CHALLENGE chance card is selected, said card indicating a challenger and a challengee, then I. assigning a position A to said selecting player;

II. assigning a position B to the most previous player;

III. assigning a position C to a remaining player;

IV. said challengee describing to the satisfaction of the challenger at least two scriptures related to the challenger's last selected scripture card, said descriptions being provided within one (1) minute; and V. removing the challenger's selected scripture card and CHALLENGE chance card from said challenger's game playing board if said descriptions are deemed to be sufficiently described; and (r) repeating step (i) by the next player.

14. The method of playing a board game of claim 10, wherein said game is won by a player who first places all of said scripture cards and all of said chance cards in said corresponding labeled boxes.

* * * * *